US006196816B1

(12) United States Patent
Lifson et al.

(10) Patent No.: US 6,196,816 B1
(45) Date of Patent: Mar. 6, 2001

(54) UNEQUAL INJECTION PORTS FOR SCROLL COMPRESSORS

(75) Inventors: Alexander Lifson, Manlius; James W. Bush, Skaneateles, both of NY (US)

(73) Assignee: Carrier Corporation, Syracuse, NY (US)

( * ) Notice: Subject to any disclaimer, the term of this patent is extended or adjusted under 35 U.S.C. 154(b) by 0 days.

(21) Appl. No.: 09/290,331

(22) Filed: Apr. 12, 1999

Related U.S. Application Data

(60) Provisional application No. 60/096,722, filed on Aug. 17, 1998.

(51) Int. Cl.[7] ..... F01C 1/02

(52) U.S. Cl. ..... 418/55.6; 418/97

(58) Field of Search ..... 418/55.6, 97

(56) References Cited

U.S. PATENT DOCUMENTS

| | | | | |
|---|---|---|---|---|
| 5,253,489 | * | 10/1993 | Yoshii | 418/55.6 |
| 5,329,788 | * | 7/1994 | Caillat et al. | 418/55.6 |
| 5,927,088 | * | 7/1998 | Shaw | 62/175 |
| 5,996,364 | * | 12/1999 | Lifson et al. | 62/196.1 |

FOREIGN PATENT DOCUMENTS

| | | | | |
|---|---|---|---|---|
| 768464 | * | 11/1996 | (EP) | 418/55.6 |
| 0754861 A2 | | 1/1997 | (EP) . | |
| 0768464 A2 | | 4/1997 | (EP) . | |
| 0754861 A3 | | 3/1998 | (EP) . | |
| 0768464 A3 | | 6/1998 | (EP) . | |
| 0922860 A1 | | 6/1999 | (EP) . | |
| 57-153984 | | 9/1982 | (JP) . | |
| 58170879 | * | 10/1983 | (JP) | 418/55.6 |
| 63-147982 | | 6/1988 | (JP) . | |
| 04203851 | * | 7/1992 | (JP) | 418/55.6 |
| 04321786 | | 11/1992 | (JP) . | |
| 08144971 | | 11/1994 | (JP) . | |
| 63147982 | * | 11/1996 | (JP) | 418/55.6 |
| 11-230065 | * | 6/1999 | (JP) | 418/206.1 |

OTHER PUBLICATIONS

European Search Report dated Nov. 9, 1999.
Japanese Abstract of Patent 04321786.
Japanese Abstract of Patent 08144971.
Japanese Abstract of Patent 63147982.

* cited by examiner

*Primary Examiner*—Thomas Denion
*Assistant Examiner*—Theresa Trieu
(74) *Attorney, Agent, or Firm*—Carlson, Gaskey & Olds

(57) ABSTRACT

Scroll compressors are provided with injection ports for injecting fluid from a supplemental source such as an economizer cycle or by-passing fluid through an unloader valve. The injection ports are formed in each of two compression chambers whose volume is being reduced towards a discharge port. Due to various design constraints, it is desirable that the injection ports have unequal characteristics. In some cases, it may be desirable to make the injection ports of different size, including width, depth, and length. In other applications, it may be desirable to locate the injection ports at different angular positions relative to compression chambers seal off from suction.

2 Claims, 2 Drawing Sheets

UNEQUAL INJECTION PORTS FOR SCROLL COMPRESSORS

This application claims priority to U.S. Provisional Application 60/096,722, filed Aug. 17, 1998.

BACKGROUND OF THE INVENTION

This invention relates to the optimization of the size and/or location of injection ports for use in scroll compressors.

Scroll compressors are becoming widely utilized in refrigerant compression applications. Scroll compressors are generally formed of an orbiting and a non-orbiting scroll member. Both of the scroll members have spiral wraps extending from their respective base plates. The spiral wraps of orbiting and non-orbiting members interfit to define compression chambers. Typically, at least two compression chambers are being moved concurrently towards a discharge port compressing the refrigerant.

One compressor feature which has been used in scroll compressors and has increased the efficiency of the overall refrigerant system is an economizer cycle. An economizer cycle provides thermodynamic benefits as a supplemental fluid is injected into the scroll compressor compression chambers at a position downstream of the suction inlet.

In addition to economizer cycle or as a stand alone feature an unloader valves can also be incorporated into scroll compressors design to selectively by-pass the refrigerant from a more compressed location back to a less compressed location.

With either an economizer cycle, and/or with an unloader valve, there is an injection port for each of the two compression chambers. Thus, in known scroll compressors there has typically been a pair of injection ports associated with either the economizer cycle or by-pass operation utilizing the unloader valve.

The injection ports are usually formed through the non-orbiting scroll, and they have both been of an equal cross-sectional area, equal depth, located at equal angular position in each compression chamber with respect to suction chamber seal off point.

The use of equal injection ports has created some inefficiencies and concerns. As an example, there may be unequal pressure drops in the connecting lines leading to each of the ports due to differences in the line geometries.

Also unequal flow may occur due to the use of so-called hybrid profiles for the scroll wraps. Scroll wraps once had an essentially uniform thickness throughout their entire wrap. More recently, scroll wraps have been optimized to have a varying thickness along a wrap. Thus, a scroll wrap portion associated with one injection port may have a very different thickness than a scroll wrap portion associated with the other. The different thickness could then change the amount of time that each of the ports is uncovered by the orbiting scroll wrap.

SUMMARY OF THE INVENTION

In a disclosed embodiment of this invention, the two injection ports are formed to be unequal, and/or be positioned at different angular positions in each compression chamber with respect to suction chambers seal off point to achieve desired design characteristics. As one example, the two injection ports can be of different cross-sectional areas, including width, depth or length. In this way, the scroll designer is able to tailor the flow through the two injection ports to achieve an optimum flow into each compression chamber.

The exact size and position of the two injection ports is preferably tailored to achieve an approximately balanced mass flow of fluid to each of the compression chambers, although in some applications it may be unbalanced flow which is sought by the designer. By providing an approximately balanced amount of refrigerant injection into each chamber, pressure in each compression chamber remains to be equal and thus mixing losses which occur when two chambers merge that may have occurred in the prior art are eliminated. Further, pulsation and sounds due to unequal pressure in compression chambers are reduced.

With the present invention, a scroll compressor designer determines the optimum size (width, length and depth) of the port, and also an optimum location. By doing this, the design of the two injection ports is selected to achieve desired characteristics. The size, position, etc. can be determined experimentally or analytically. It is the use of differently sized or positioned ports which is inventive.

These and other features of the present invention can be best understood from the following specification and drawings, the following of which is a brief description.

DETAILED DESCRIPTION OF A PREFERRED EMBODIMENT

Figure 1A:
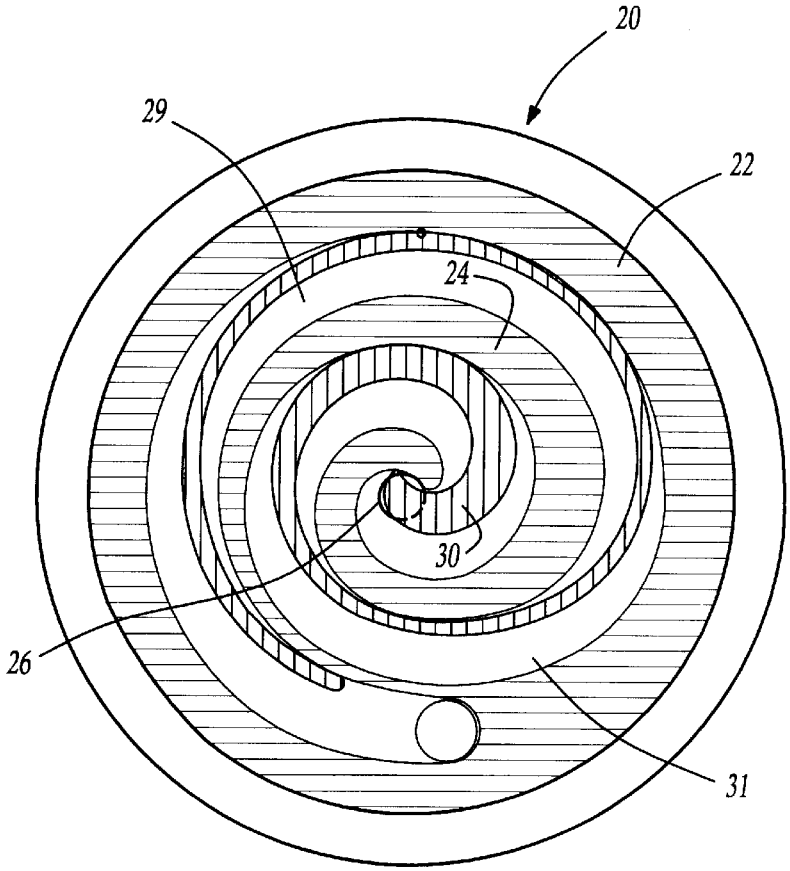
Fig-1A Prior Art
FIG. 1A shows a prior art scroll compressor.

FIG. 1A shows a known scroll compressor pump element 20 having a non-orbiting scroll 22 with a wrap 24. As shown, wrap 24 starts from an approximate center point 26, and expands generally along a spiral to an outer location. As also shown, an orbiting scroll wrap 30 interfits with scroll wrap 24, and defines a plurality of compression chambers such as chambers 29 and 31.

Figure 1B:
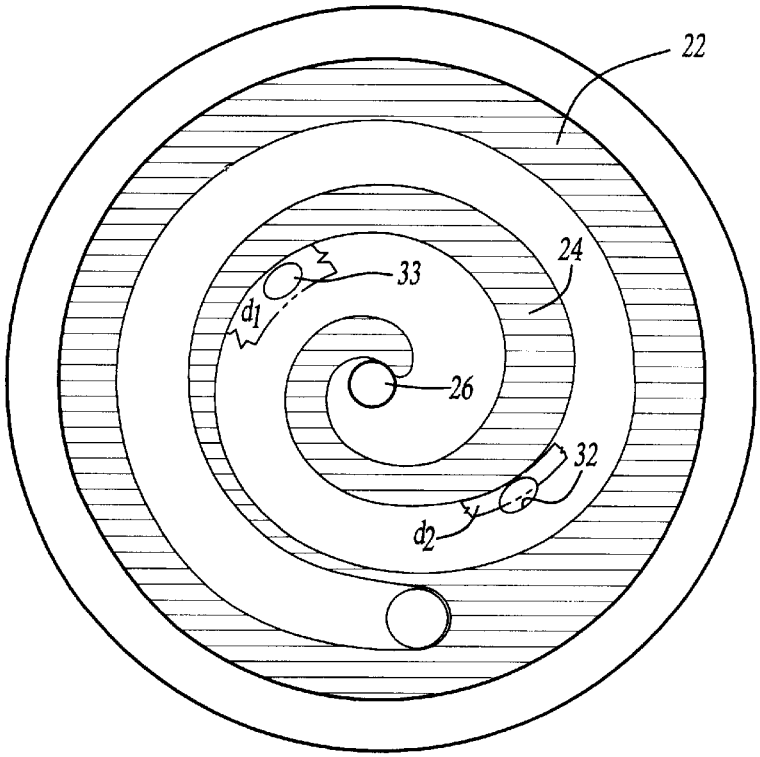
Fig-1B Prior Art
FIG. 1B shows one of the FIG. 1A compressor members.

As shown in FIG. 1B, injection ports 33 and 32 selectively communicate with chambers 31 and 29, respectively.

Figure 2:
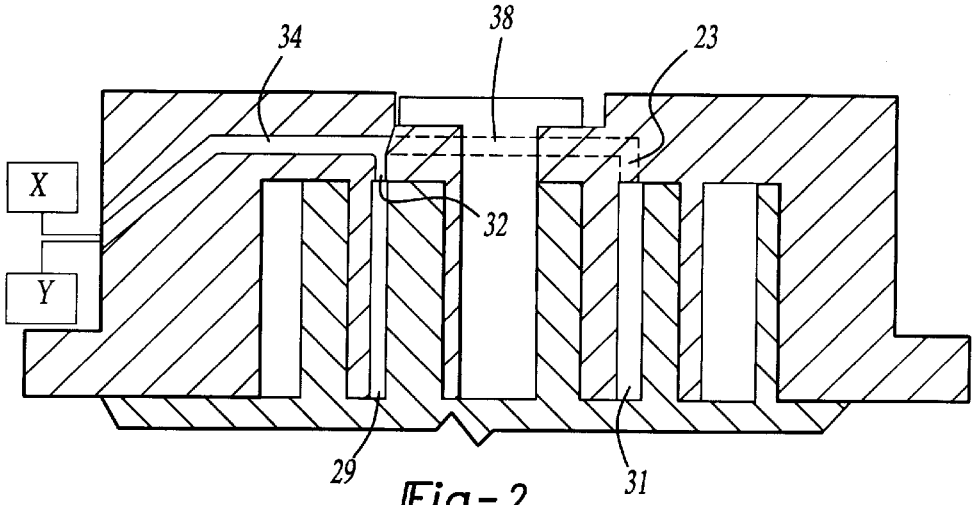
Fig-2 Prior Art
FIG. 2 shows a feature of the fluid supply of scroll compressors generally.

As shown in FIG. 2, passage 34 communicates to port 32. Passage 34 communicates through passages 38 to port 33. Passage 38 is often curved to avoid the intersection with the discharge port. For this reason, the passage is shown in phantom. Passage 34 may communicate within an economizer cycle (x), or with an unloader valve (y), or both, shown schematically.

As can be appreciated from FIG. 2, fluid passing to port 33 must travel through a much longer distance than the fluid passing to port 32. Thus, the pressure drops associated with passage into two ports, 33, 32 is quite distinct. This will affect the mass flow of fluid into the two ports.

Moreover, as can be appreciated from FIG. 1A, the thickness of the wraps varies along their length. These so-called "hybrid wraps" are a recent development in scroll compressor technology. The orbiting scroll wrap moves over ports 33 and 32 and selectively opens each port to allow flow into the chambers 31 and 29. However, as shown in phantom in FIG. 1B, since the orbiting scroll wrap thickness d1 in the area of port 33 is distinct from the scroll wrap thickness d2 in the area of port 32, there are distinct opening times for each port with the prior art single sized ports. Again, this can result in unequal mass flow into the two ports.

Notably, the ports 33 and 32 also have been typically located at approximately equal angular position in each compression chamber with respect to their seal off point from suction and have typically been formed of identical cross-sectional area. Thus, with the prior art equal sized and positioned ports had unequal mass flow entering chambers 31 and 29.

Figure 3:
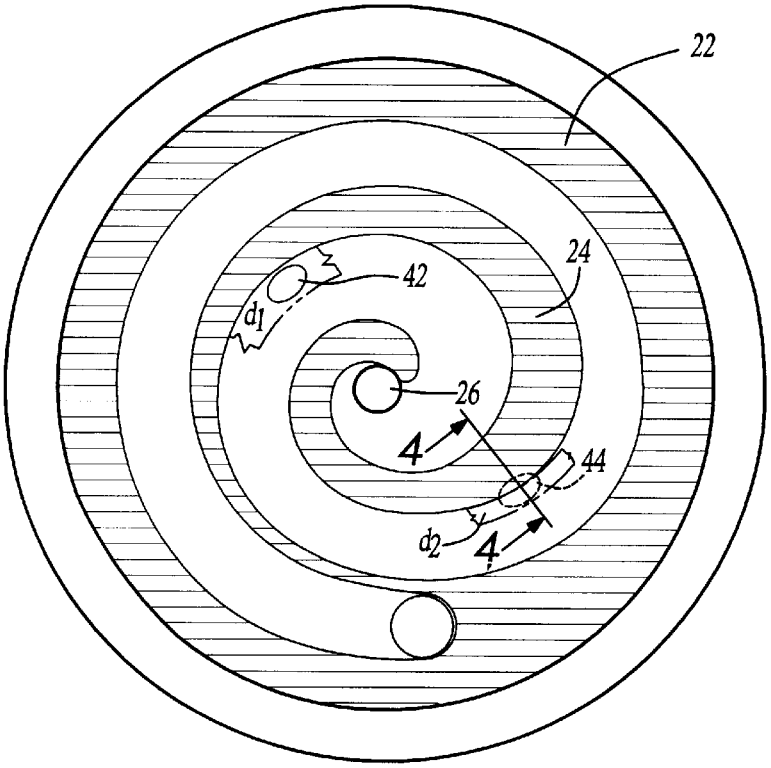
FIG. 3 shows the inventive scroll compressor.

The present invention addresses this problem as shown in FIG. 3. Ports 42 and 44 in the FIG. 3 embodiment are of different cross-sectional areas, and associated with compression chambers 31 and 29, respectively. It should be understood that the relative sizes may be exaggerated to illustrate the point. As shown, the port 44 is smaller than the port 42. The port 42 needs to be of a larger size to compensate for a longer opening time of port 44. The port 44 remains open for a longer time because the orbiting scroll is thinner at location d2 than at location d1. This may be desirable given the approximate size of the wraps, or the other conditions in the compression chamber 29 compared to the compression chamber 31. Further, the port with the greatest resistance to flow due to its supply "plumbing" (FIG. 2) may be provided with the greater cross-sectional area to compensate for the additional resistance of the line 38 leading to this port.

Figure 4:
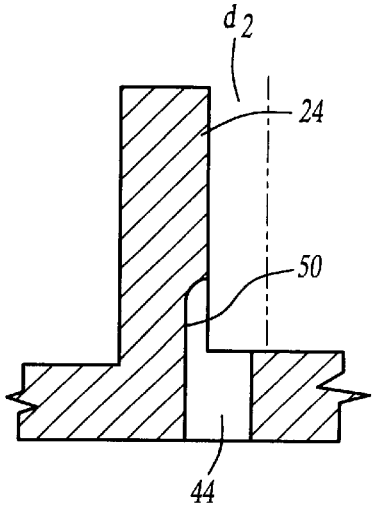
FIG. 4 is a cross-sectional view along line 4—4 of FIG. 3.

As shown in FIG. 4, port 44 may have an undercut 50 into the wrap 24. This undercutting may actually be quite slight, but allows the provision of a greater cross-sectional area as flow enters the compression chamber. Without the undercut the effective port area would be significantly reduced and the port width would be reduced to the thickness of orbiting scroll at d2. In general, the port width cannot be made greater than orbiting scroll wrap thickness at this location, otherwise a high to low leak over wrap tips between compression chambers will result. By undercutting the port into the wrap, this problem is avoided.

A worker in this art would be able to experimentally or analytically determine the optimum size, depth and width of the ports 42 and 44. Moreover, the optimum angular location of the ports along the fixed scroll wrap can also be determined. Thus, as the two ports are designed they can be unequal both in size and/or position.

By providing unequally sized and positioned ports, the present invention is able to achieve approximately balanced mass flow, or other desired flow characteristics, into the two compression chambers. It should be understood that the illustrated embodiment is simply one application. Other arrangements can result given different fluid passage arrangements, wrap profiles, etc.

A preferred embodiment of this invention has been disclosed. However, a worker of ordinary skill in this art would recognize that certain modifications would come within the scope of this invention. For that reason, the following claims should be studied to determine the true scope and content of this invention.

What is claimed is:

1. A scroll compressor comprising:

an orbiting scroll member having a base and a wrap extending from said base, said orbiting scroll wrap having a non-uniform thickness along its length;

a non-orbiting scroll member having a base and a wrap extending from said base, said wrap of said non-orbiting scroll wrap also having a non-uniform thickness along its length, said orbiting and said non-orbiting scroll wraps interfitting to define a plurality of compression chambers;

a suction port and a discharge port;

said non-orbiting scroll communicating through a passage with a source of refrigerant, said passage extending through said base of said non-orbiting scroll into at least two injection ports at a location intermediate said suction and discharge ports, and said two injection ports associated with at least two of said compression chambers, said injection ports being unequal in at least one of size and position; and wherein one of said injection ports has a portion undercut into said non-orbiting scroll wrap.

2. A scroll compressor as recited in claim 1, wherein said injection ports are associated with an economizer cycle.

* * * * *